US010287126B2

(12) United States Patent
Tan et al.

(10) Patent No.: US 10,287,126 B2
(45) Date of Patent: May 14, 2019

(54) RECYCLING BIN

(71) Applicant: GRG Banking Equipment Co., Ltd., Guangzhou, Guangdong (CN)

(72) Inventors: Dong Tan, Guangdong (CN); Heng Liu, Guangdong (CN); Hongjun Wu, Guangdong (CN); Zhuang Jiang, Guangdong (CN)

(73) Assignee: GRG Banking Equipment Co., Ltd., Guangzhou, Guangdong (CN)

( * ) Notice: Subject to any disclaimer, the term of this patent is extended or adjusted under 35 U.S.C. 154(b) by 0 days.

(21) Appl. No.: 15/571,815

(22) PCT Filed: Apr. 6, 2016

(86) PCT No.: PCT/CN2016/078535

§ 371 (c)(1),
(2) Date: Nov. 3, 2017

(87) PCT Pub. No.: WO2016/180102

PCT Pub. Date: Nov. 17, 2016

(65) Prior Publication Data

US 2018/0346198 A1 Dec. 6, 2018

(30) Foreign Application Priority Data

May 13, 2015 (CN) ..... 2015 1 0242885

(51) Int. Cl.
*B65H 29/40* (2006.01)
*B65D 25/10* (2006.01)
(Continued)

(52) U.S. Cl.
CPC ..... *B65H 29/40* (2013.01); *B65D 25/10* (2013.01); *B65D 85/62* (2013.01); *B65H 29/52* (2013.01);
(Continued)

(58) Field of Classification Search
CPC ..... B65H 29/40; B65H 29/42; B65H 31/00; B65H 31/26
(Continued)

(56) References Cited

U.S. PATENT DOCUMENTS 3,166,313 A * 1/1965 Rehm ..... B65H 29/22 271/178
4,275,874 A * 6/1981 DiBlasio ..... B65H 29/40 271/178
(Continued)

FOREIGN PATENT DOCUMENTS

CN 1669898 A 9/2005
CN 1876540 A 12/2006
(Continued)

OTHER PUBLICATIONS

Extended European Search Report for Application No. EP 16791952.1 dated Apr. 30, 2018.
(Continued)

*Primary Examiner* — David H Bollinger
(74) *Attorney, Agent, or Firm* — Wolf, Greenfield & Sacks, P.C.

(57) ABSTRACT

A recycle box includes a box door and a box bottom housing. A recycle inlet is provided at a top of the box bottom housing. A guide elastic strip, a banknote guiding plate, an impeller and a banknote stacking plate are fixed inside the box bottom housing. The guide elastic strip and the banknote guiding plate are vertically and oppositely arranged, there is a gap between the guide elastic strip and the banknote guiding plate and the gap is a recycle passage. The banknote guiding plate is provided with a first stopper for placing the recycled media and an opening for flexible blades to pass through, and the recycled media are placed on the first stopper after passing through the recycle passage. The flexible blade conveys the recycled media onto the banknote
(Continued)

stacking plate. The impeller has a small diameter and the recycle box has a reduced volume accordingly.

14 Claims, 6 Drawing Sheets

(51) Int. Cl.
*B65D 85/62* (2006.01)
*G07D 11/00* (2019.01)
*B65H 29/52* (2006.01)
*B65H 31/10* (2006.01)

(52) U.S. Cl.
CPC ..... *B65H 31/10* (2013.01); *G07D 11/00* (2013.01); *B65H 2301/33214* (2013.01); *B65H 2301/33222* (2013.01); *B65H 2404/1114* (2013.01); *B65H 2404/231* (2013.01); *B65H 2404/611* (2013.01); *B65H 2404/72* (2013.01); *B65H 2405/1115* (2013.01); *B65H 2701/1912* (2013.01)

(58) Field of Classification Search
USPC ..... 271/177, 178
See application file for complete search history.

(56) References Cited

U.S. PATENT DOCUMENTS

| | | | | |
|---|---|---|---|---|
| 2002/0113366 | A1* | 8/2002 | Watanabe | B65H 5/34 271/315 |
| 2004/0135304 | A1 | 7/2004 | Tokunaga et al. | |
| 2007/0278736 | A1* | 12/2007 | Onodera | B65H 29/14 271/178 |
| 2009/0014946 | A1* | 1/2009 | Nagura | B65H 31/18 271/220 |
| 2011/0042889 | A1 | 2/2011 | Holland-Letz et al. | |
| 2016/0101953 | A1 | 4/2016 | Suetaka et al. | |

FOREIGN PATENT DOCUMENTS

| | | | |
|---|---|---|---|
| CN | 1880207 | A | 12/2006 |
| CN | 102007058 | A | 4/2011 |
| CN | 102163347 | A | 8/2011 |
| CN | 104943948 | A | 9/2015 |
| EP | 2 028 146 | A2 | 2/2009 |
| JP | 2008-308324 | A | 12/2008 |
| JP | 2010-173759 | A | 8/2010 |
| JP | 2014-229186 | A | 12/2014 |
| WO | WO 2014/125968 | A1 | 8/2014 |
| WO | WO 2014/199711 | A1 | 12/2014 |
| WO | WO 2016/180102 | A1 | 11/2016 |

OTHER PUBLICATIONS

International Search Report (ISR) and Written Opinion for Application No. PCT/CN2016/078535 dated May 26, 2016.

* cited by examiner

RECYCLING BIN

This application is the national phase of International Application No. PCT/CN2016/078535, titled "RECYCLING BIN", filed on Apr. 6, 2016, and claims priority to Chinese patent application No. 201510242885.0, titled "RECYCLE BOX", filed with the Chinese State Intellectual Property Office on May 13, 2015, the entire disclosures of both applications are incorporated herein by reference.

FIELD

The embodiments of the present application relate to a paper-type article collecting device for collecting paper-type articles such as banknotes, checks, securities and the like inside the device, and particularly relate to a recycle box.

BACKGROUND

Recycle boxes are widely used in the financial equipment, and are core mechanisms prepared for functions such as storage, arranging, conveying, bundling and transportation. The recycle box, after being assembled with components such as a housing member (for example, a box body), forms a recycle box, a circulation box, and a temporary storage module.

The currently described mechanism employing an impeller to stack banknotes is just a typical and common recycle box. In order to ensure the insertion of the paper-type articles, the impeller should have a relatively large diameter in a depth direction, the minimum diameter is about 83 mm, and the maximum diameter is about 160 mm, or to avoid using an impeller having a large diameter, the mechanical structure and electrical control need to be updated.

The recycle box in the conventional technology has drawbacks that the impeller has a large diameter and thus is not adapted to a narrow space, and the recycle box has a large volume.

SUMMARY

A recycle box is provided according to the embodiments of the present application, which employs an impeller having flexible blades to enable the impeller to be still usable normally in a narrow space, and the impeller has a small diameter and the recycle box may have a reduced volume accordingly.

A recycle box in the technical solution according to an embodiment of the present application includes: a box door and a box bottom housing. A recycle inlet is provided at a top of the box bottom housing, a guide elastic strip, a banknote guiding plate, an impeller, and a banknote stacking plate configured to stack recycled media are fixed inside the box bottom housing. The impeller has a plurality of flexible blades. The guide elastic strip and the banknote guiding plate are arranged vertically and face to face, and there is a gap between the guide elastic strip and the banknote guiding plate, and the gap is a recycle passage. The banknote guiding plate is provided with a first stopper for placing the recycled media and an opening for the flexible blade to pass through, and the recycled media are placed on the first stopper after passing through the recycle inlet and the recycle passage. The flexible blade conveys the recycled media on the first stopper onto the banknote stacking plate when the flexible blades are rotated out of the opening.

Preferably, the banknote guiding plate includes a first banknote guiding vertical surface, a banknote guiding toothed surface, a banknote guiding circular-arc surface, an banknote guiding inclined surface and a second banknote guiding vertical surface which are connected in the listed sequence. There is a gap between the guide elastic strip and the first banknote guiding vertical surface, and the banknote guiding toothed surface is the first stopper and is configured to temporarily store the recycled media passing through the recycle inlet and the recycle passage sequentially.

Preferably, the guide elastic strip includes an guiding inclined surface and a guiding vertical surface connected to a lower end of the guiding inclined surface, the distance between the guiding inclined surface and the first banknote guiding vertical surface is decreased gradually, and a distance between the guiding vertical surface and the first banknote guiding vertical surface is equal to a minimum distance between the guiding inclined surface and the first banknote guiding vertical surface.

Preferably, the recycle inlet is enclosed by a left guide tooth and a right guide tooth.

Preferably, the number of the impeller is at least two, and the guide elastic strip is positioned between each adjacent impellers.

Preferably, a maximum distance between the guiding inclined surface and the first banknote guiding vertical surface is equal to a distance between the left guide tooth and the right guide tooth or is greater than the distance between the left guide tooth and the right guide tooth by 1 mm to 3 mm.

Preferably, the distance between the guiding vertical surface and the first banknote guiding vertical surface ranges from 2 mm to 5 mm.

Preferably, the banknote stacking plate is a flat surface or an inclined surface.

Preferably, a banknote guiding circular-arc fillet and a third banknote guiding vertical surface are provided inside the box door, and the banknote stacking plate is located between the third banknote guiding vertical surface and the second banknote guiding vertical surface.

Preferably, an elastic component is connected between the banknote stacking plate and a bottom portion of the box bottom housing, and the elastic component is compressed by the banknote stacking plate when the recycled media are stacked on the banknote stacking plate.

The present application has beneficial effects as follows. Since the guide elastic strip, the banknote guiding plate, the impeller and the banknote stacking plate are fixed inside the box bottom housing of the recycle box, and the guide elastic strip and the banknote guiding plate are vertically and oppositely arranged, and a gap, i.e. the recycle passage is formed between the guide elastic strip and the banknote guiding plate, and the recycle passage is used for allowing the falling of the recycled media. When the recycled media fall onto the first stopper of the banknote guiding plate which is configured to temporarily store the recycled media after passing through the recycle inlet and the recycle passage, the flexible blade of the impeller passes through the opening of the banknote guiding plate and is rotated out of the opening of the banknote guiding plate, and the flexible blade conveys the recycled media on the first stopper onto the banknote stacking plate. When the flexible blade comes into contact with the banknote stacking plate as the recycled media increase in the process of rotation, it will be deformed to a certain extent and not be restored to the original shape. With the technical solution, since the flexible blade may be continually deformed, the impeller may have a reduced diameter, and thus the volume of the recycle box will be reduced accordingly.

BRIEF DESCRIPTION OF THE DRAWINGS

For more clearly illustrating embodiments of the present application or the technical solutions in the conventional technology, drawings referred to describe the embodiments or the conventional technology will be briefly described hereinafter. Apparently, the drawings in the following description are only examples of the present application, and for those skilled in the art, other drawings may be obtained based on the provided drawings without any creative efforts.

DETAILED DESCRIPTION

A recycle box is provided according to an embodiment of the present application which can be configured to recycle media such as banknotes (paper currencies), checks or securities. In this embodiment, the structure and connecting relationship of the components of the recycle box are explained by taking banknotes (paper currencies) as the recycled media of the recycle box 100. It is to be noted that, the type of the media to be recycled can be paper-type articles such as banknotes (paper currencies), checks or securities, and is not specifically limited in practical application.

The technical solutions in the embodiments of the present application will be described clearly and completely hereinafter in conjunction with the drawings in the embodiments of the present application. Apparently, the described embodiments are only a part of the embodiments of the present application, rather than all embodiments. Based on the embodiments in the present application, all of other embodiments, made by those skilled in the art without any creative efforts, fall into the scope of the present application.

Figure 1:
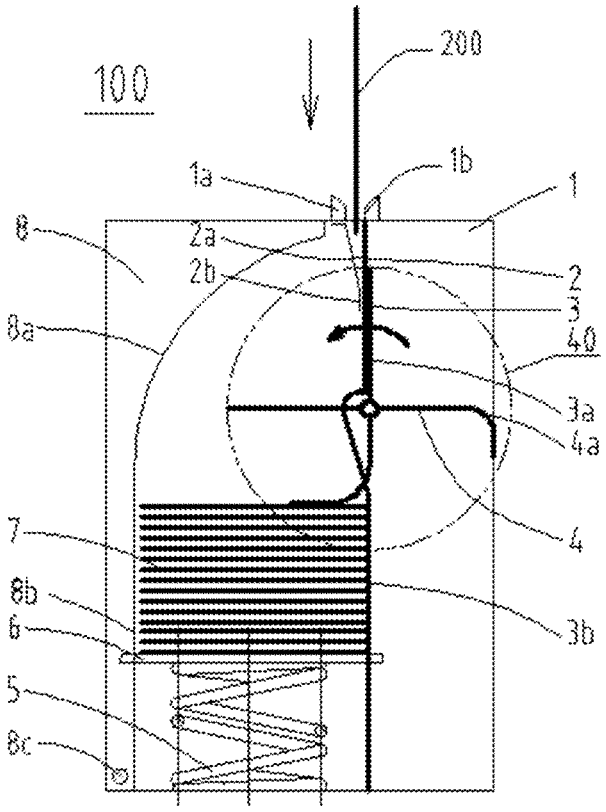
FIG. 1 is an overall layout view of a recycle box according to an embodiment of the present application.

As shown in FIG. 1, a recycle box 100 includes a box door 8 and a box bottom housing 1 connected to the box door 8. The box door 8 may be opened to allow the banknotes inside the box bottom housing 1 to be taken out.

A recycle inlet is provided at the top of the box bottom housing 1. A guide elastic strip 2, a banknote guiding plate 3, an impeller 4 and a banknote stacking plate 6 are fixed inside the box bottom housing 1. An elastic component 5 is connected between the banknote stacking plate 6 and a bottom portion of the box bottom housing 1. The guide elastic strip 2 and the banknote guiding plate 3 are arranged vertically and arranged face to face, and a gap is included between the guide elastic strip and the banknote guiding plate and defines a recycle passage. The banknote guiding plate 3 is provided with a first stopper and the banknotes fall onto the stopper after passing through the recycle inlet and the recycle passage. The banknote guiding plate 3 is provided with an opening for a flexible blade 4*a* of the impeller 4 to pass through, and the flexible blade 4*a* may rotate by 360 degrees about an impeller shaft. When being rotated out of the opening of the banknote guiding plate 3, the flexible blade 4*a* conveys the banknotes on the first stopper of the banknote guiding plate 3 onto the banknote stacking plate 6 and the banknote stacking plate 6 is configured to stack banknotes.

With the technical solution described above, since the guide elastic strip, the banknote guiding plate, the impeller and the banknote stacking plate are fixed inside the box bottom housing of the recycle box, and the guide elastic strip and the banknote guiding plate are arranged vertically and arranged face to face, and a gap, i.e. the recycle passage is formed between the guide elastic strip and the banknote guiding plate, and the recycle passage is used for receiving the fallen recycled media, when the recycled media fall onto the first stopper of the banknote guiding plate configured to temporarily store the recycled media after passing through the recycle inlet and the recycle passage, the flexible blade of the impeller passes through the opening of the banknote guiding plate and is rotated out of the opening of the banknote guiding plate, and the flexible blade conveys the recycled media on the first stopper onto the banknote stacking plate. In the rotation process, as the recycled media increase, the flexible blade may be deformed to a certain extent when coming into contact with the banknote stacking plate and may not be restored to the original shape. With the technical solution, since the flexible blade may be continually deformed, the impeller may have a small diameter, and thus the volume of the recycle box may be reduced accordingly.

Figure 2:
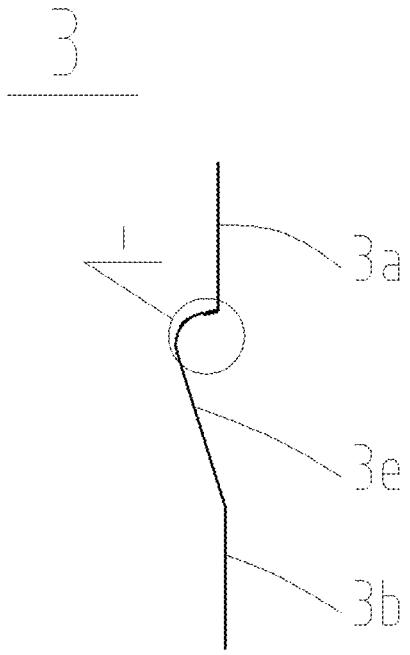
FIG. 2 is a sectional view of a banknote guiding plate 3 in FIG. 1.
Figure 3:
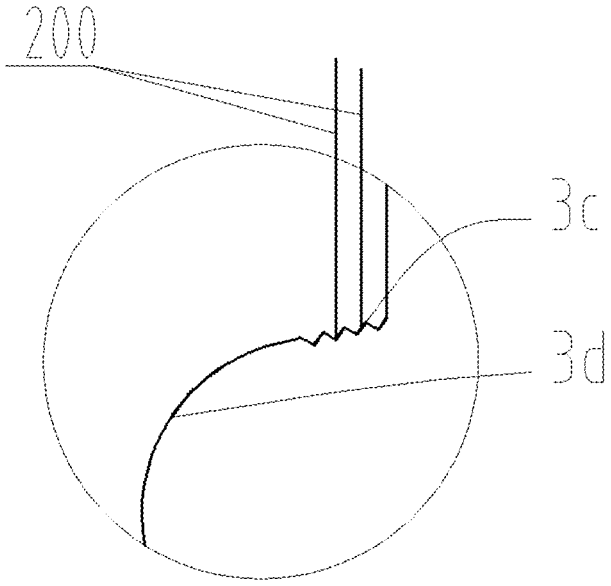
FIG. 3 is a partially enlarged view showing an area I of the banknote guiding plate 3 in FIG. 2.

Preferably, as shown in FIGS. 2 and 3, the banknote guiding plate 3 includes a first banknote guiding vertical surface 3*a*, a banknote guiding toothed surface 3*c*, a banknote guiding circular-arc surface 3*d*, a banknote guiding inclined surface 3*e*, and a second banknote guiding vertical surface 3*b* which are connected in the listed sequence. The first stopper described above is the banknote guiding toothed surface 3*c*. The banknote guiding circular-arc surface 3*d* is transitionally connected to the first banknote guiding vertical surface 3*a* through the banknote guiding toothed surface 3*c* with saw teeth. The first banknote guiding vertical surface 3*a* extends upward from a tip end on a right side of the banknote guiding toothed surface 3*c*. The second banknote guiding vertical surface 3*b* is located below the banknote guiding circular-arc surface 3*d* which is coplanar with the first banknote guiding vertical surface 3*a*. The second banknote guiding vertical surface 3*b* is transitionally connected to the banknote guiding circular-arc surface 3*d* through the banknote guiding inclined surface 3*e*.

The toothed saw teeth of the banknote guiding toothed surface 3*c* function as a cushion when a banknote falls onto the banknote guiding toothed surface 3*c*, and allows several banknotes 200 to be vertically arranged on the banknote guiding toothed surface 3*c* at the same time. The uppermost banknote may be conveyed toward the second banknote guiding vertical surface 3*b* of the banknote guiding plate 3 when the blade of the impeller 4 slides toward the top surface of the banknote stacking plate 6, which is advantageous for order stacking of the collected banknotes.

The impeller 4 may be mounted at an axis position of the banknote guiding circular-arc surface 3*d* of the banknote guiding plate 3. The impeller 4 is provided with uniformly distributed blades 4*a*, each of the blades 4*a* has flexibility functioning to allow the size of the housing to be reduced, and has a certain rigidity functioning to stabilize a rotational conveying of the banknotes.

Preferably, as shown in FIG. 1, the guide elastic strip 2 includes an guiding inclined surface 2*a* and a guiding vertical surface 2*b* connected to a lower end of the banknote guiding inclined surface. A distance between the guiding inclined surface 2*a* and the first banknote guiding vertical surface 3*a* of the banknote guiding plate 3 is decreased gradually. The distance between the guiding vertical surface 2*b* and the first banknote guiding vertical surface 3*a* is the same as a minimum distance between the guiding inclined surface 2*a* and the first banknote guiding vertical surface 3*a*.

The reason why the distance between the guiding inclined surface 2*a* and the first banknote guiding vertical surface 3*a* of the banknote guiding plate 3 is gradually decreased is that: the recycle box 100, as a module required to be frequently removed so as to be opened for counting of banknotes, is required to hand over banknotes with an original passage opening of the machine core. In order to enable the banknotes to enter he recycle box 100 so as to realize a reliable banknote-passing, a box body inlet passage of the recycle box should be wider; the gap between the guiding vertical surface 2*b* and the first banknote guiding vertical surface 3*a* of the banknote guiding plate 3 is equal to the minimum gap between the guiding inclined surface 2*a* and the first banknote guiding vertical surface 3*a* of the banknote guiding plate 3 to ensure the banknotes to be reliably and stably transferred to the passage with a normal width from the wider passage.

Preferably, as shown in FIG. 1, the recycle inlet is formed by a left guide tooth 1*a* and a right guide tooth 1*b*, which is convenient for handing over the banknotes entering from other modules. The distance from the banknote guiding toothed surface 3*c* to the left guide tooth 1*a* and the right guide tooth 1*b* of the recycle inlet of the box bottom housing 1 should be greater than a maximum width of the banknotes to be collected. The guide elastic strip 2 may be mounted at an inner side of a lower portion of the left guide tooth 1*a* of the box bottom housing 1. There is a gap between the guiding inclined surface 2*a* and the first banknote guiding vertical surface 3*a* of the banknote guiding plate 3, and the gap defines a recycle passage. A maximum width of the gap between the guiding inclined surface 2*a* and the first banknote guiding vertical surface 3*a* of the banknote guiding plate 3 is equal to a width of a gap between the left guide tooth 1*a* and the right guide tooth 1*b* or is greater than the width of the gap between the left guide tooth 1*a* and the right guide tooth 1*b* by 1 mm to 3 mm. The guiding vertical surface 2*b* and the first banknote guiding vertical surface 3*a* face to face with a gap therebetween ranging from 2 mm to 5 mm. The banknote guiding plate 3 is mounted at an inner side of a lower portion of the right guide tooth 1*b* of the box bottom housing 1, and the first banknote guiding vertical surface 3*a* is coplanar with a banknote-passing surface of the right guide tooth 1*b* or slightly deviates rightwards with respect to the banknote-passing surface.

Preferably, the box door 8 is hinged to the box bottom housing 1, and is capable of rotating about a door shaft 8*c* to be opened for counting the banknotes. A circular-arc-shaped guiding fillet 8*a* is provided at an inner side of an upper part of the box door 8. A stacking space for the banknotes is defined by the second banknote guiding vertical surface 3*b* of the banknote guiding plate 3 and the third banknote guiding vertical surface 8*b* of the box door 8 together. The banknote stacking plate 6 is located between the third banknote guiding vertical surface 8*b* and the second banknote guiding vertical surface 3*b*. The space is slightly greater than the width of the banknotes to be collected, for example the space is greater than the width of the banknotes to be collected by 3 mm to 5 mm.

Preferably, the elastic component may be a banknote stacking plate restoring spring 5, the shape of which is not limited to a tapered or cylindrical shape. The banknote stacking plate 6 is mounted at a central top of the banknote stacking plate restoring spring 5. Whether or not the banknote stacking plate 6 is equipped with a shaft having a guide effect does not affect the realization of the functions of the mechanism.

Figure 7:
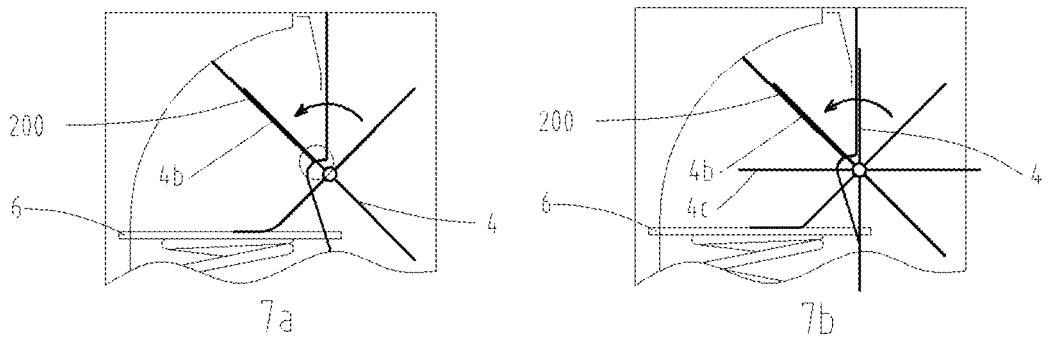
FIG. 7 is a schematic view of the recycle box in FIG. 1 showing the number of blades and banknote conveying manner.

Preferably, as shown in FIGS. 1 and 7, the impeller 4 has at least one blade, and the number of the blades is not limited to four as illustrated. The orderliness degree of the banknotes 200 being stacked by the impeller 4 depends on the number of the blades, a rotational speed of the impeller and a banknote feeding speed. The manner in which the banknotes are conveyed is determined by the number of the blades when the rotational speed of the blades and the speed of advancement of the banknotes are constant. As shown in FIG. 7*a*, the time during which the blade 4*a* as shown in FIG. 1 (horizontally arranged) is switched to the blade 4*b* as shown in FIG. 7 is just sufficient for one banknote 200 to enter. In this case, if the number of the blades is less than four, more than one banknote 200 is allowed to be temporarily stacked on the banknote guiding toothed surface 3*c* of the banknote guiding plate 3. The banknotes are forced to rotate by the blade 4*b* when being conveyed, and the blade 4*b* is not spaced apart from the banknote stacking plate 6. As shown in FIG. 7*b*, if the number of the blades is greater than four, the banknotes 200 are pressed by the blades to slide over the banknote guiding circular-arc fillet 8*a* on the box door 1, and the blades 4*b*, 4*c* are respectively located at a front side and a rear side of the banknote, which is advantageous for the turnover conveying of the banknotes, i.e., the banknotes 200 are spaced apart from the banknote stacking plate 6 by the blade 4*c*. If the banknotes are not spaced apart from the banknote stacking plate 6 by the blade 4*c*, the banknotes 200 may fall onto the banknote stacking plate 6 freely when the impeller 4 is stopped due to a failure, which is disadvantageous for the order stacking of the banknotes. The spaced design can effectively avoid this issue.

Figure 8:
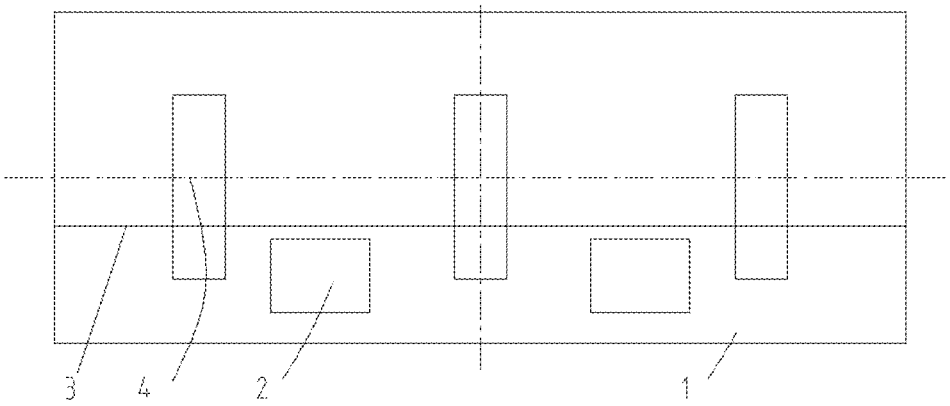
FIG. 8 is a schematic view of impellers and banknote guiding elastic strips of the recycle box in FIG. 1 being alternately arranged.

Preferably, as shown in FIG. 8, the number of the impellers 4 is at least two, and the guide elastic strip may be more than one. The guide elastic strip 2 is located between adjacent impellers 4, and the impellers 4 and the guide elastic strips 2 are alternately arranged.

Figure 9:
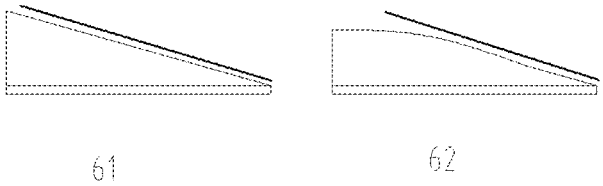
FIG. 9 is a schematic view of variations of a top surface for stacking banknotes of the banknote stacking plate 6 of the recycle box in FIG. 1.

Preferably, as shown in FIG. 9, the shape of the top surface of the banknote stacking plate 6 may be changed into various forms, such as an inclined plane 61 or a cambered surface 62, to reduce a driving force required when the blade slides, which may not affect the function of the present application.

The operation process of the recycle box will be explained in conjunction with FIGS. 3 to 6, the drive and detection systems of the impeller 4 are not illustrated and the impeller 4 is unidirectionally rotated counterclockwise.

Figure 4:
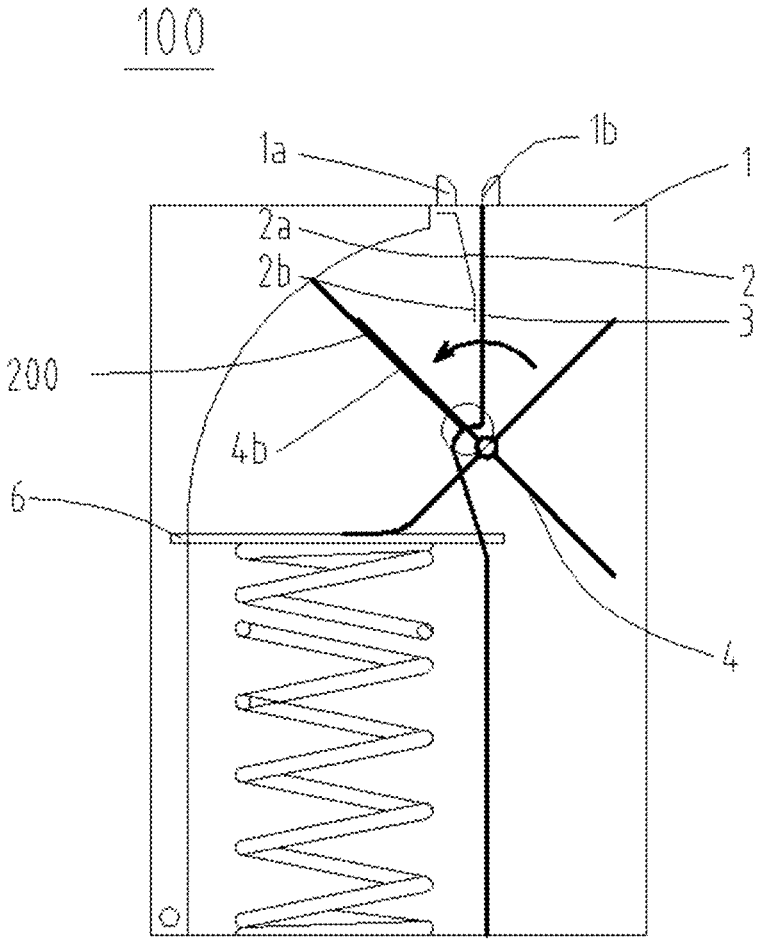
FIG. 4 is a schematic view of the recycle box in FIG. 1 in a banknote-feeding state.

As shown in FIG. 4, when there is no banknote on the banknote stacking plate 6, the banknote stacking plate is located at an upper limit position under the action of the banknote stacking plate restoring spring 5.

When the banknotes are required to enter the recycle box 100, a control section issues an instruction such that the impeller 4 rotates counterclockwise, and the banknotes, after entering via the space between the left guide tooth 1*a* and the right guide tooth 1*b*, fall along the guiding inclined surface 2*a* of the guide elastic strip 2, and the recycle passage defined by the guiding vertical surface 2*b* and the first banknote guiding vertical surface 3*a* of the banknote guiding plate 3 in sequence onto the banknote guiding toothed surface 3*c* of the banknote guiding plate.

Figure 5:
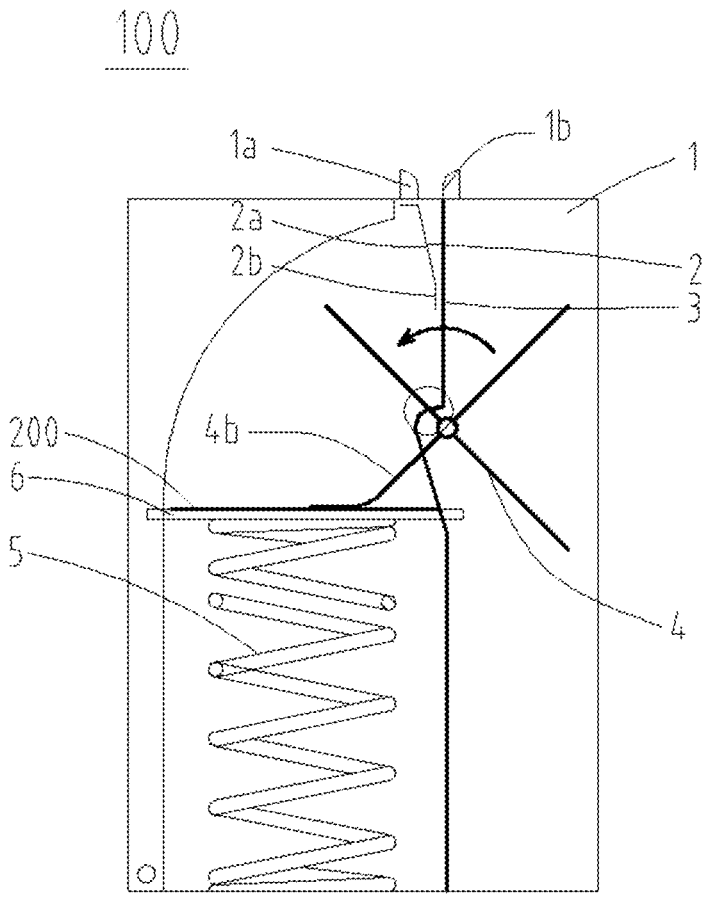
FIG. 5 is a schematic view of the recycle box in FIG. 1 showing that its impeller conveys banknotes.

As shown in FIGS. 4 and 5, when one of the blades of the impellers 4, such as the blade 4*b*, is rotated out of the opening of the banknote guiding plate 3, the banknotes 200 may be pressed against a lower portion of the blade 4*b* in the rotational direction while being conveyed to the banknote stacking plate 6 along the banknote guiding plate 3.

Figure 6:
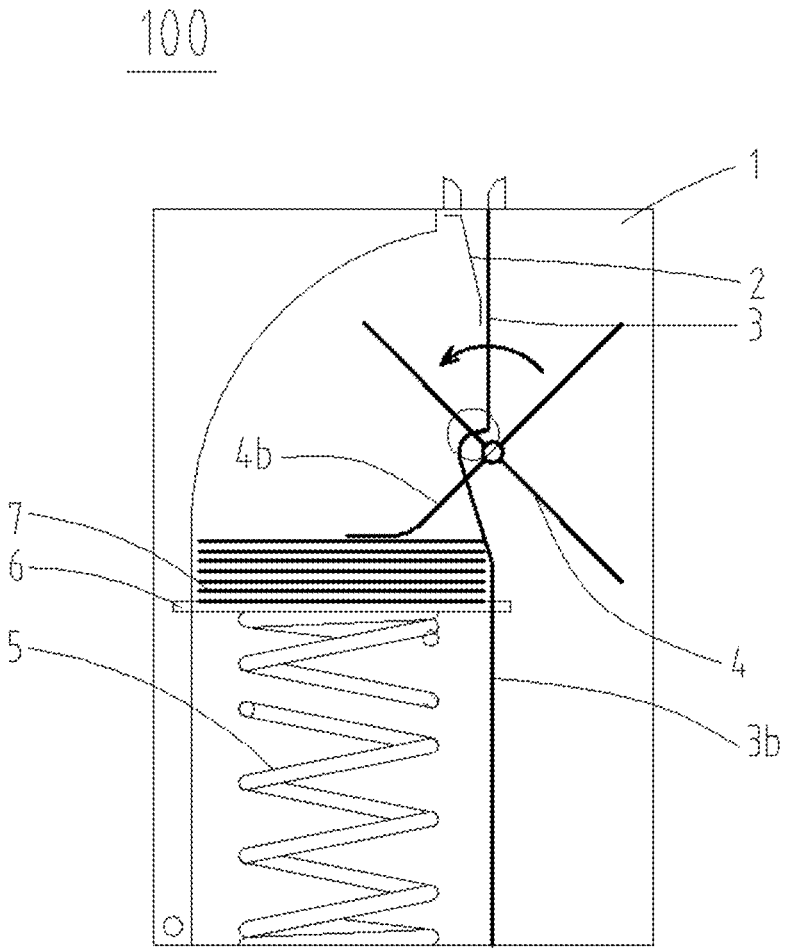
FIG. 6 is a schematic view of a banknote stacking plate of the recycle box in FIG. 1 when stacking banknotes.

After the banknotes enter continuously, the banknote stacking plate restoring spring 5 is compressed under the deadweight of the banknote stacking plate 6, the weight of the banknotes stacked and a pressing component force generated by the flexible blades of the impeller 4 sliding across the top of the banknotes stacked, thus vacating an upper part space for collecting banknotes, as shown in FIG. 6, till the banknote stacking plate restoring spring 5 is pressed to a maximum degree and it is detected that the capacity of the recycle box 100 reaches the limit (the detection system is not shown).

A control system may control the operation timing of the impeller 4, and the impeller 4 may always rotate counter-clockwise, which will not affect the functions described in this application.

The invention claimed is:

1. A recycle box, comprising a box door and a box bottom housing, wherein:

a recycle inlet is provided at a top of the box bottom housing, a guide elastic strip, a banknote guiding plate, an impeller and a banknote stacking plate configured to stack recycled media are fixed inside the box bottom housing;

the impeller has a plurality of flexible blades, the guide elastic strip and the banknote guiding plate are arranged vertically and arranged face to face, there is a gap between the guide elastic strip and the banknote guiding plate, and the gap is a recycle passage;

the banknote guiding plate is provided with a first stopper configured to place the recycled media and is provided with an opening configured to allow the flexible blades to pass through, the recycled media are placed on the first stopper after passing through the recycle inlet and the recycle passage, the flexible blades convey the recycled media on the first stopper onto the banknote stacking plate when the flexible blades are rotated out of the opening.

2. The recycle box according to claim 1, wherein the banknote guiding plate comprises a first banknote guiding vertical surface, a banknote guiding toothed surface, a banknote guiding circular-arc surface, an banknote guiding inclined surface and a second banknote guiding vertical surface which are connected in the listed sequence, a gap is provided between the guide elastic strip and the first banknote guiding vertical surface, and the banknote guiding toothed surface is the first stopper and is configured to temporarily store the recycled media passing through the recycle inlet and the recycle passage sequentially.

3. The recycle box according to claim 2, wherein a banknote guiding circular-arc fillet and a third banknote guiding vertical surface are provided inside the box door, and the banknote stacking plate is located between the third banknote guiding vertical surface and the second banknote guiding vertical surface.

4. The recycle box according to claim 2, wherein the number of the impeller is at least two, and the guide elastic strip is positioned between each adjacent impellers.

5. The recycle box according to claim 2, wherein the guide elastic strip comprises an guiding inclined surface and a guiding vertical surface connected to a lower end of the guiding inclined surface, a distance between the guiding inclined surface and the first banknote guiding vertical surface is decreased gradually, and a distance between the guiding vertical surface and the first banknote guiding vertical surface is equal to a minimum distance between the guiding inclined surface and the first banknote guiding vertical surface.

6. The recycle box according to claim 5, wherein the distance between the guiding vertical surface and the first banknote guiding vertical surface ranges from 2 mm to 5 mm.

7. The recycle box according to claim 5, wherein the number of the impeller is at least two, and the guide elastic strip is positioned between each adjacent impellers.

8. The recycle box according to claim 5, wherein the recycle inlet is enclosed by a left guide tooth and a right guide tooth.

9. The recycle box according to claim 8, wherein a maximum distance between the guiding inclined surface and the first banknote guiding vertical surface is equal to a distance between the left guide tooth and the right guide tooth or is greater than the distance between the left guide tooth and the right guide tooth by 1 mm to 3 mm.

10. The recycle box according to claim 8, wherein the number of the impeller is at least two, and the guide elastic strip is positioned between each adjacent impellers.

11. The recycle box according to claim 8, wherein the distance between the guiding vertical surface and the first banknote guiding vertical surface ranges from 2 mm to 5 mm.

12. The recycle box according to claim 1, wherein the number of the impeller is at least two, and the guide elastic strip is positioned between each adjacent impellers.

13. The recycle box according to claim 1, wherein the banknote stacking plate is a flat surface or an inclined surface.

14. The recycle box according to claim 1, wherein an elastic component is connected between the banknote stacking plate and a bottom portion of the box bottom housing, and the elastic component is compressed by the banknote stacking plate when the recycled media are stacked on the banknote stacking plate.

* * * * *